United States Patent [19]

Kouchich et al.

[11] 4,069,465

[45] Jan. 17, 1978

[54] CYLINDRICAL VARISTOR AND METHOD OF MAKING THE SAME

[75] Inventors: Allan V. Kouchich, Milwaukee; Robert Marshall, Mequon, both of Wis.

[73] Assignee: Allen-Bradley Company, Milwaukee, Wis.

[21] Appl. No.: 704,156

[22] Filed: July 12, 1976

[51] Int. Cl.[2] ..... H01C 7/10

[52] U.S. Cl. ..... 338/20; 29/610 R; 29/613; 29/621; 338/274; 338/327; 338/329; 427/103

[58] Field of Search ..... 338/20, 21, 233, 273, 338/274, 308, 322, 327, 329; 29/610, 613, 619, 620, 621; 252/518, 518.3, 521, 521.3; 427/101, 102, 103, 123, 126

[56] References Cited

U.S. PATENT DOCUMENTS

| | | | |
|---|---|---|---|
| 3,380,936 | 4/1968 | Masuyama et al. | 338/20 X |
| 3,725,836 | 4/1973 | Wade et al. | 338/21 |
| 3,753,198 | 8/1973 | Shimizu | 338/20 |
| 3,760,318 | 9/1973 | Masayama et al. | 338/20 |
| 3,768,058 | 10/1973 | Harnden, Jr. | 338/20 |
| 3,808,575 | 4/1974 | Brandt | 338/276 X |

*Primary Examiner*—C. L. Albritton
*Attorney, Agent, or Firm*—Quarles & Brady

[57] ABSTRACT

A varistor has a cylindrical core made of a sintered varistor material which includes a longitudinal opening between the core ends. A pair of terminating layers are applied to the core, each adhering to one of the ends of the core and being in electrical contact with a lead wire inserted into the longitudinal opening. An electrode film is applied to the outer longitudinal surface of the core with each end in communication with one of the terminating layers. The electrode film is divided between the terminating layers into a pair of electrode portions by a gap which is dimensioned to predetermine the electrical properties of the varistor. The preferred method of manufacture involves forming a sintered, cylindrical core of varistor material with a longitudinal opening; applying a terminating layer to each end of the core; applying an electrode film to the core surface with each end of the core in contact with one of the terminating layers; dividing the film into a pair of electrode portions by forming a gap between the ends of the film; and inserting a lead wire into each end of the core opening in contact with one of the terminating layers.

20 Claims, 9 Drawing Figures

CYLINDRICAL VARISTOR AND METHOD OF MAKING THE SAME

BACKGROUND OF THE INVENTION

This invention relates to a varistor, and more particularly to a cylindrical varistor whose properties are dependent upon the geometry of a gap separating the electrodes and a method of making the same. A varistor is a voltage variable resistor, and its electrical behavior is commonly described by the following characteristic relationship:

$$I = (V/C)^{\alpha}$$

wherein:

I = current flowing through the varistor;
V = voltage across the varistor;
C = constant; and
$\alpha$ = constant > 1; measure of the non-linearity of the varistor.

A number of varistors are known in the art which can be referred to as bulk type varistors. A bulk device is disclosed in U.S. Pat. No. 3,496,512, issued on Feb. 17, 1970 to Matsuoka, et al. for "Non-Linear Resistors," having a sintered body of zinc oxide with silver paint electrodes applied to opposite surfaces. The properties are dependent upon the bulk of the device; i.e., the non-linearity is determined to a considerable extent by the composition of the sintered body, and the value of C is controlled by the dimension of the body between the electrodes. There are many other devices of a similar construction in which the sintered body includes together with zinc oxide various metal oxides to effectuate an increase in the non-linearity property. See, for example, U.S. Pat. No. 3,632,528, issued on Jan. 4, 1972 to Matsuoka, et al. for "Lead-Modified Zinc Oxide Voltage Variable Resistor;" U.S. Pat. No. 3,634,337, issued on Jan. 11, 1972 to Matsuoka, et al. for "Barium-Modified Zinc Oxide Voltage Variable Resistor;" U.S. Pat. No. 3,598,763, issued on Aug. 10, 1971 to Matsuoka, et al. for "Manganese-Modified Zinc Oxide Voltage Variable Resistor;" and U.S. Pat. No. 3,699,058 issued on Oct. 17, 1972 to Matsuoka, et al. for "Uranium-Modified Zinc Oxide Voltage Variable Resistor."

Such varistors have been fabricated in both disc and cylindrical shapes—a varistor material is initially formed into the desired shape and an electrode is applied to each end. A lead wire is then attached to each electrode, and this step is followed by enclosure of the varistor material and the electrodes within a conformal coating. Although the properties of the varistors can be varied by adjusting the thickness of the varistor material, there is difficulty in forming the material to achieve precise results.

It is also important that a strong bond between the leads and the varistor body is obtained. A significant problem has arisen in the bulk devices presently available in that there has been a tendency for the electrodes to splinter in the vicinity of the attachments of the leads. Also, the electrodes in some devices have become dissociated from the varistor material. Either occurrence can result in a failure of a varistor device thus introducing transient voltages into a circuit that is to be protected. In order to overcome these difficulties, the patent issued to May, U.S. Pat. No. 3,903,404, on Sept. 2, 1975 for "Metal Oxide Varistor With Coating That Enhances Contact Adhesion" provides a coating which is applied to the varistor material before the electrodes are applied. Although this approach can result in an improved bond between the electrodes and the varistor body, the attachment between the electrodes and the lead wires does not appear to be appreciably strengthened. Also, the electrodes still may lose some degree of structural integrity near the leads due to mechanical stresses.

Recently, other varistors have been developed in which the properties are independent of the dimensions of the varistor body. In U.S. Pat. No. 3,768,058, issued on Oct. 23, 1973 to Harnden, Jr. for "Metal Oxide Varistor With Laterally Spaced Electrodes," a pair of electrodes are applied to the same surface of the varistor body. Since the separation between the electrodes is less than the thickness of the body, the width of the separation determines the voltage level across the electrodes. This construction thus allows improved control over the voltage characteristics of the varistor for it is unnecessary to control the thickness of the varistor body. However, there is no disclosure of the use of this type of device in a cylindrical form; nor is there any indication that the device can be adapted to overcome the mechanical deficiencies observed in the bulk devices. The prior art also lacks and teaching of how the electrode separation can be controlled to adjust the voltage characteristics, as well as other varistor properties. Also, there is still a need for a method which can be employed to produce a varistor whose properties are independent of the size of the varistor body.

It is against this background that the present invention introduces a cylindrical varistor whose properties are readily adjusted during fabrication and which has mechanical advantages over presently existing bulk devices. A method of making such cylindrical varistors is also provided.

SUMMARY OF THE INVENTION

The present invention contemplates a cylindrical varistor which includes a cylindrical core made of a sintered varistor material. An electrode film is bonded to the core surface, and it is divided into a pair of electrode portions by a gap which is dimensioned to predetermine the properties of the varistor. A lead wire is inserted into an opening at each end of the core in electrical contact with one of the electrode portions.

The invention also contemplates a method of making such a construction involving preparing the sintered core, applying the electrode film to the core surface and dividing it into the electrode portions by forming the gap with a proper sizing and geometry, and inserting each lead wire into a core opening to form firm mechanical bonds. In the preferred embodiment, after formation of the core, a terminating layer is applied to each end. The electrode film is then applied to the core with each end of the film in contact with one of the terminating layers. The film is preferably formed by depositing an electrode paste on the core and heating the coated core until the paste hardens to form a film in ohmic contact with the core. This step is followed by division of the film by formation of the gap between the ends of the film—the varistor properties are easily fashionable at this point for they can be adjusted by properly cutting the gap to an appropriate size. Next, a lead wire is inserted into the opening at each end of the core to provide a strong union with the core and a firm electrical contact with the electrode film. The core can then be encapsulated within a protective coating; and, to enhance adhesion of the film to the core, a thin glaze of glass can be applied to the film prior to encapsulation.

The structure and method of the invention provide a varistor construction that is excellent from the standpoints of device characteristics, precise properties and mechanical integrity. There is a strong bond between the electrode film and the sintered core, and a firm mechanical fit between the lead wires and the core. The construction, is, however, still relatively easy to manufacture; in general, the sintered core is prepared and the remainder of the device is built up in a sequential fashion to provide a varistor in a cylindrical configuration having many desirable features.

It is an object of the invention to provide a cylindrical varistor whose properties can be readily and accurately predetermined.

It is another object of the invention to provide a cylindrical varistor having sound mechanical integrity.

It is a further object of the invention to provide a cylindrical varistor that is relatively simple and inexpensive to manufacture.

It is a still further object of the invention to provide a method of making a cylindrical varistor which is easy to perform and which is flexible in producing a varistor with desired properties.

The foregoing and other objects and advantages of the invention will appear from the following description. In the description, reference is made to the accompanying drawings which form a part hereof, and in which there is shown by way of illustration and not of limitation preferred embodiments of the invention. Such embodiments do not represent the full scope of the invention, but rather the invention may be employed in a variety of forms, and reference is made to the claims herein for determining the breadth of the invention.

DESCRIPTION OF THE PREFERRED EMBODIMENTS

Figure 1:
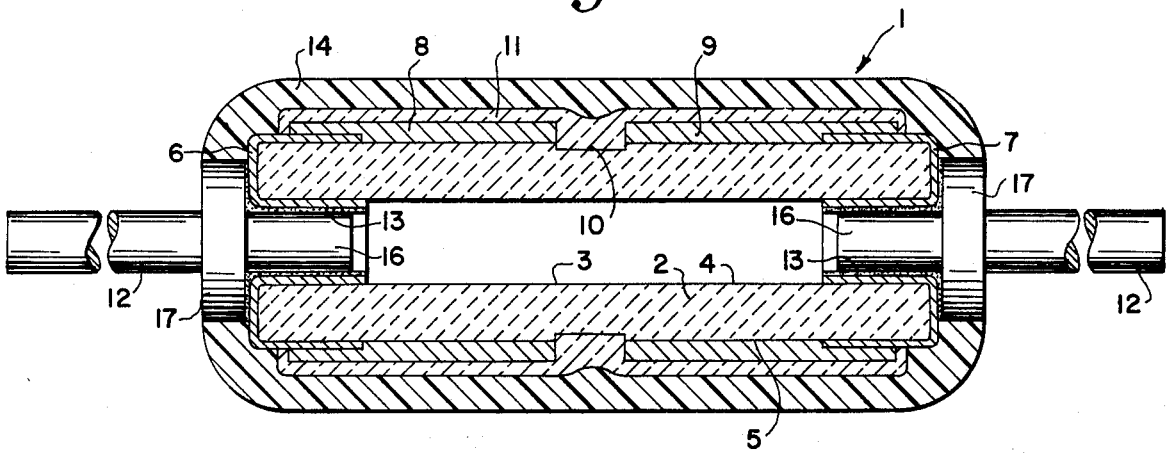
FIG. 1 is a view in cross section of a first preferred embodiment of a cylindrical varistor of the present invention.

Referring to FIG. 1 of the drawings, there is shown a varistor 1 having a core 2 made of a sintered varistor material. The core 2 is in a tubular or circular, cylindrical form, and it has an axial opening 3 between its ends to provide inner and outer longitudinal surfaces 4 and 5, respectively. A pair of terminating layers 6 and 7 are disposed on the core ends, and they are applied so that each one extends onto both the inner longitudinal surface 4 and the outer longitudinal surface 5. A pair of electrode portions 8 and 9 are bonded to the outer longitudinal surface 4 between the terminating layers 6 and 7, the electrode portion 8 being in contact with the terminating layer 6 and the electrode portion 9 being in contact with the terminating layer 7.

The electrode portions 8 and 9 are separated by a gap 10 that extends below the outer longitudinal surface 5 into the core 2. The dimensions of the gap 10 are carefully sized to adjust the properties of the varistor 1 to desired specifications. It has been found that the knee voltage of the varistor—i.e., the initial voltage at which the device behavior departs from Ohm's law—can be controlled to within certain limits. The knee voltage can be adjusted to within about 25% of the desired value by setting the separation between the electrode portions 8 and 9 to a predetermined distance. This distance is the sum of the width of the gap 10 between the electrode portions 8 and 9 and the depth to which the gap 10 depends into the core 2.

Figure 2:
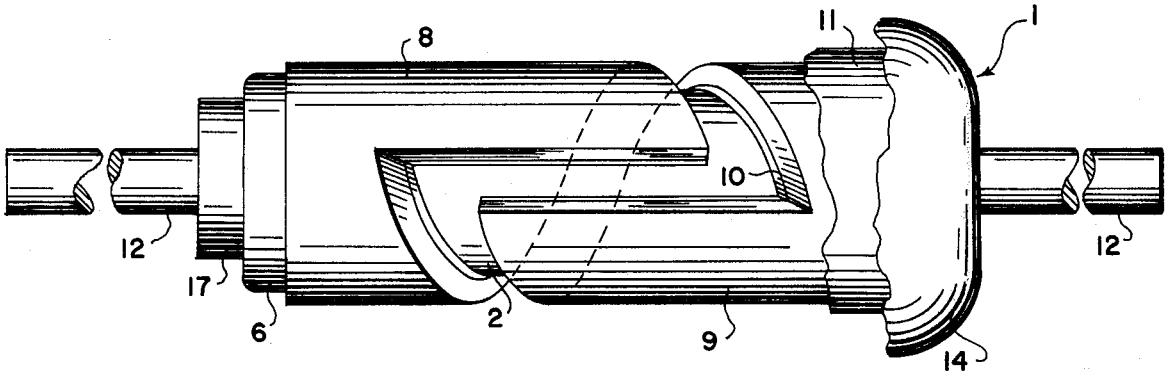
FIG. 2 is a side plan view with parts cut away of a second preferred embodiment of the present invention.
Figure 3:
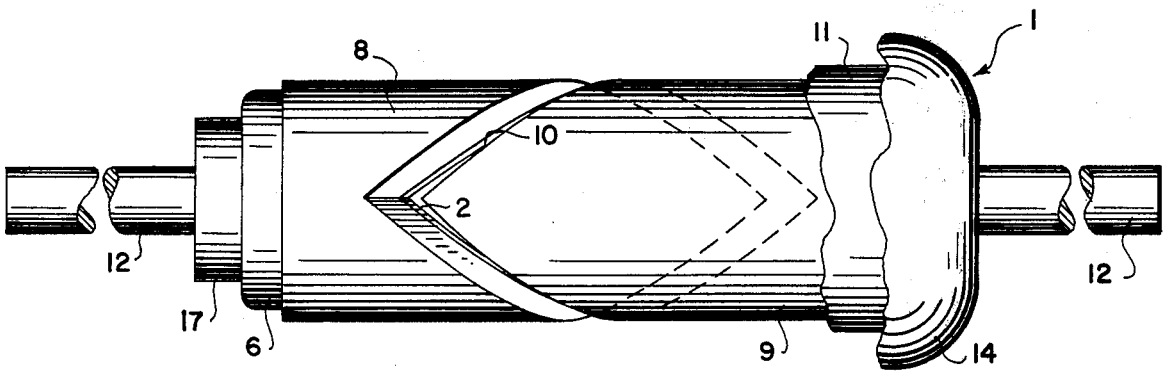
FIG. 3 is a side plan view with parts cut away of a third preferred embodiment of the present invention.
Figure 4A:
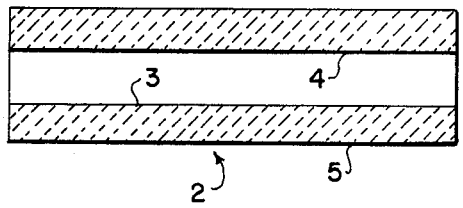
FIGS. 4*a*–4*f* constitute a schematic portrayal of the steps of a preferred method for manufacturing the varistor of the present invention.
Figure 4B:
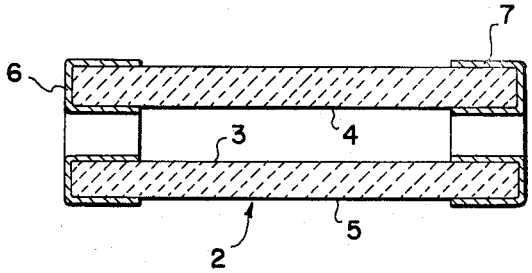
Figure 4C:
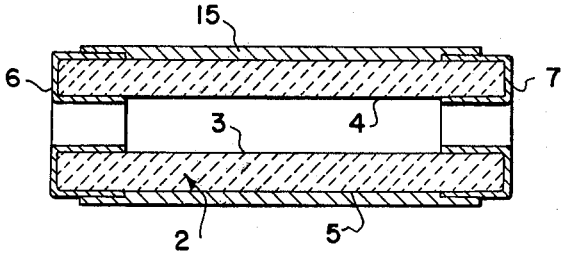
Figure 4D:
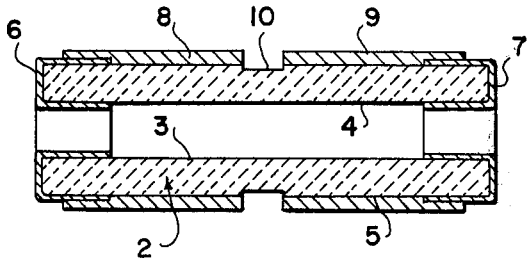
Figure 4E:
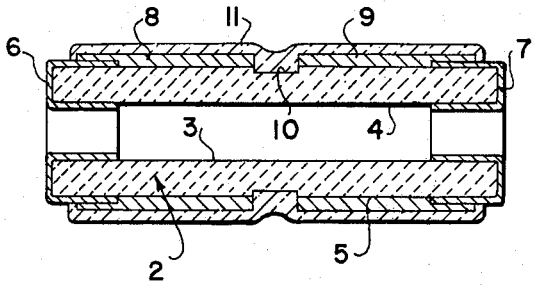
Figure 4F:
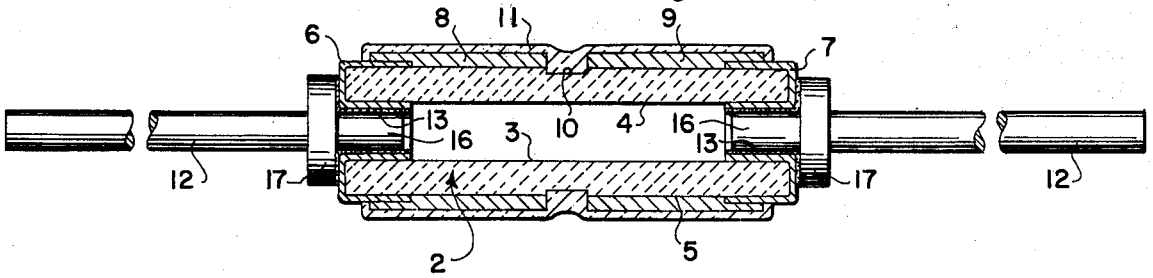

The gap 10 also has a length dimension which can be adjusted to preselect the maximum peak pulse current handling capability of the device. It has been found that the total area of the gap 10 affects this value; thus, once the width and depth dimensions are sized to achieve a particular knee voltage, the appropriate gap length can be determined to provide the desired current capabilities. In this connection, the cylindrical configuration of the core 2 is particularly advantageous for it is highly suitable for use in proper dimensioning of the gap 10, as will be described more fully hereinafter. The length of the gap 10 can be adjusted by selecting a particular gap geometry for formation along the core circumference. This geometry can take a wide variety of forms, some of which are illustrated in FIGS. 1–3. In FIG. 1, the gap 10 is circular; while, in FIG. 2 it is a single turn spiral, and in FIG. 3 it is an ellipse.

Referring again to FIG. 1, a thin glaze of glass 11 is applied to the exterior of the electrode portions 8 and 9, and it fills the gap 10. It is preferable to employ such a layer, although the varistor 1 can be fabricated without it. A pair of lead wires 12 are inserted into the axial opening 3; each lead wire 12 is in electrical communication with either of the terminating layers 6 or 7. An interference fit is provided between each lead wire 12 and the axial opening 3, and a solder bond 13 is used to insure a strong union. A conformal coating 14 encloses the coated core and protects it from environmental conditions.

With reference to FIGS. 4*a* through 4*f*, the preferred method of making a cylindrical varistor, such as the one shown in FIG. 1, involves initially preparing the core 2. The core 2 preferably comprises a semi-conductive material and a glass matrix. A composition which has been found suitable includes a semi-conductive material having, by mole percent, approximately 98.8 percent zinc oxide, 0.5 percent chromium oxide, 0.2 percent cobalt oxide and 0.5 percent manganese oxide, and a glass matrix containing, by weight percent, approximately 11 percent boric anhydride, 62 percent bismuth trioxide, 11 percent silicon dioxide, 8 percent cobalt oxide and 8 percent manganese dioxide. The combination of about 90–95 weight percent semi-conductive material and about 10–5 weight percent glass matrix is mixed with a binder system. An acceptable binder system may include about 7.3 weight percent of a mixture of polyvinyl alcohol, polyethylene glycol, ammonium stearate, a wetting agent (such as Darvan C) and G. E. Antifoam together with about 92.7 weight percent of deionized water. The mixture is dried and formed into a flowable powder by any common ceramic processing technique, e.g., drying and granulation, spray drying, etc. The powder is pressed in a die into a cylindrical configuration with an axial opening 3, and the tube is fired at a temperature within the range from about 900° C to about 1400° C for a time period of sufficient length to allow formation of a sintered core 2. It should be apparent, however, that alternative compositions and binder systems may be used, and other processing procedures could be employed in making a core 2 which is suitable in the practice of the present invention.

Next, the ends of the core 2 are coated with a mixture having the rheology of an ink. The ink is preferably a silver, palladium-silver or palladium-gold mixture, and one mixture found suitable is sold commercially as Silver Paste 8706 by E. I. DuPont de Nemours and Company, Wilmington, Del. The latter mixture comprises approximately 66–69 percent silver, 3.7–5.9 percent glass matrix, and the remainder, an organic carrier. It is important to properly adjust the viscosity of the ink so that it can be applied sequentially to each end of the core 2 in a manner such that it will flow partially into the axial opening 3 and will adhere to both the inner and outer longitudinal surfaces 4 and 5. The coated core is then fired at a temperature of about 800° to about 900° C to form the terminating layers 6 and 7.

This procedure is followed by the formation of the electrode portions 8 and 9 on the core 2. This involves depositing an electrode paste on the outer longitudinal surface 5 so that it partially overlaps both terminating layers 6 and 7. The preferred electrode paste, like the terminating layer material, is a silver, palladium-silver or palladium-gold mixture, and a paste such as Silver Paste 8706 can also be used. The paste is deposited by rolling the core 2 over an applicator containing the paste or by using any other suitable technique such as a transfer wheel. The paste is then dried to evaporate any liquid constituents and fired at a temperature of about 800° C to about 900° C to form an electrode film 15 in ohmic contact with the core 2.

The electrode film 15 is then divided into a pair of sections—the electrode portions 8 and 9—by removing part of the film down to or beneath the outer longitudinal surface 5. In this manner, the gap 10 bound by the electrode portions 8 and 9 is formed; this is accomplished by using any suitable technique, e.g., grit abrasion cutting, diamond wheel scribing or laser scribing, known in the resistor technology. The electrode material is removed in a closed path along the core periphery, and the gap 10 is formed with a set of geometrical dimensions providing predetermined device characteristics. Thus, the gap 10 is readily formed by the removal of electrode material to provide the desired separation between the electrode portions 8 and 9, and it is cut to an appropriate length by common cutting procedures. Furthermore, relatively simple apparatus can be used in performing the cutting operation—the core 2 can be mounted in chucks which allow it to both rotate about and translate along its central longitudinal axis. With a cutting device oriented perpendicular to the core 2, the circular cut shown in FIG. 1 can be made by rotating the core. The single turn spiral cut shown in FIG. 2 is made by bringing the cutting device in contact with the core 2 near one of its ends, rotating and translating the core 2 while forming a spiral, and then translating the core 2 in the reverse direction to close the cut. The elliptical cut shown in FIG. 3 is produced by uniformly translating the core 2 in one direction during 180° of rotation, and then translating it in the opposite direction during the remaining 180° to close the cut.

After formation of the gap 10, the electrode portions 8 and 9 are coated with a thin glaze of a low melting point glass 11. The glass glaze 11 may comprise a finely ground lead borosilicate glass. The glass is mixed with an organic carrier and applied in a manner similar to the deposition of the electrode paste on the core 2. The glass is then dried to eliminate part of the organic carrier and is fired at a temperature of about 500° to about 900° C to obtain a glazed surface. It has been found that this layer provides protection of the electrode portions 8 and 9, and assists in maintaining a strong bond between the electrode portions 8 and 9 and the core 2. Also, since the glass fills the gap 10, the surfaces of the gap 10 are protected which is important because of the influence of the gap 10 over the resulting varistor responses when in use.

The next procedure is the attachment of the lead wires 12 to the ends of the core 2. Each lead wire 12 has a head end 16 and a radially extending collar 17; a 90–10 solder 13 comprising about 90 percent lead and about 10 percent tin is deposited on the head ends 16. The lead wires 12 are then driven into the opposite ends of the axial opening 3 with the collars 17 abutting the core ends. There is an interference fit between the head ends 16 and the opening 3, and the 90–10 solder 13 is heated to form solder bonds between the head ends 16 and the terminating layers 6 and 7. This step allows the use of manufacturing techniques known in the resistor technology, and a detailed description of a highly satisfactory approach can be had by reference to the patent issued to Brandt, et al., U.S. Pat. No. 3,808,575, on Apr. 30, 1974, entitled "Cermet Fixed Resistor With Soldered Leads."

The remaining step involves the application of the protective, conformal coating 14 to the varistor body to enclose the core 2 and the electrode portions 8 and 9. A preferred coating material includes an epoxy resin, a phenolic resin, and a silica filler. Conventional solvents such as Cellosolve Acetate (ethylene glycol monoethyl ether ethyl acetate), methyl ethyl ketone, and alpha terpenol are added to develop a consistency suitable for application, and coloring pigments such as Pigment Dragenfeld 10363 and 10390 may be added. The coating material is heated to polymerize and cure the resin, and several layers are applied to develop a coating of desired thickness.

The preferred embodiments of the invention shown and described provide a product and a method that are highly satisfactory and offer all of the noted advantages, and others, but it will be apparent that various modifications might be made without departure from the spirit of the invention. As previously indicated, for example, various materials and formulations may be used for the components of the varistors, and different gap geometries to accomplish various varistor properties can be formed. Also, although the preferred embodiments include a core 2 having an axial opening 3 between its ends extending throughout its length, it should be apparent that the core 2 can be formed with an opening at each end extending only partially into the core interior. With the core 2 formed in this manner, the lead wires 12 can be inserted in a manner similar to that described above. Furthermore, other structural attachments which provide a firm union between the lead wires 12 and the core 2, such as disclosed in the patent issued to Steil, U.S. Pat. No. 3,329,922, on July 4, 1967, entitled "Welded Terminal Resistor" can be used. It should also be apparent that the core 2 may have a configuration other than circular cylindrical. Since the gap 10 is formed in the peripheral surface of the electrode film 15—which covers the core surface and has the same configuration—the circular, cylindrical geometry has been found to be advantageous. This form can be readily utilized in cutting the gap 10 to a desired size and shape, and it is very convenient for it facilitates use of conventional cutting apparatus known in the resistor technology. However, it should be understood that other cylindrical or tubular or other closed geometrical configurations could be suitably employed, and the word "cylindrical" as used herein contemplates these other forms. In view of these and other possible modifications, the invention is not intended to be limited by the showing or description herein, or in any other manner, except insofar as may be specifically required.

We claim:

1. A varistor, the combination comprising:

a cylindrical core made of a sintered varistor material, and having openings at its opposite ends and an outer longitudinal surface;

a pair of terminating layers, one being on each end of said core;

an electrode film on the outer longitudinal surface of said core between said terminating layers, said electrode film being divided into a pair of electrode portions by a gap;

each of said electrode portions being in communication with one of said terminating layers; and a pair of lead wires, each being inserted into an opening of said core at one end of said core and being in electrical contact with one of said terminating layers.

2. The varistor as recited in claim 1, wherein a protective coating covers said core.

3. The varistor as recited in claim 2, wherein a thin glaze of glass is interposed between said electrode portions and said protective coating.

4. The varistor as recited in claim 1, wherein each of said lead wires has a head end inserted into an opening of said core with a firm mechanical fit and an opposite end extending from the opening, and there is a solder bond between each lead wire and adjacent terminating layer.

5. The varistor as recited in claim 1, wherein said sintered core is formed by formulating a varistor powder, pressing the powder into a core, and heating the core at a temperature in the range from about 900° to about 1400° C.

6. The varistor as recited in claim 5, wherein said varistor powder comprises zinc oxide.

7. The varistor as recited in claim 6, wherein said varistor powder includes:

at least one metal oxide selected from the group consisting of cobalt oxide, chromium oxide and manganese oxide; and glass matrix consisting essentially of a borosilicate glass and at least one metal oxide selected from the group consisting of cobalt oxide and manganese oxide.

8. The varistor as recited in claim 1, wherein said terminating layers include a cermet material selected from the group consisting of silver, palladium-silver alloy and palladium-gold alloy.

9. The varistor as recited in claim 1, wherein said electrode film includes a cermet material selected from the group consisting of silver, palladium-silver alloy and palladium-gold alloy.

10. The varistor as recited in claim 1, wherein the dimensions of the gap are adjusted to predetermine the properties of the varistor.

11. The varistor as recited in claim 1, wherein the gap is formed by making a cut in said electrode film in a closed path along the periphery thereof.

12. A varistor, the combination comprising:

a cylindrical core made of a sintered varistor material and having an outer longitudinal surface;

a pair of terminating layers, one being on each end of said core;

an electrode film on the outer longitudinal surface of said core between said terminating layers, said electrode film being divided into a pair of electrode portions by a gap;

each of said electrode portions being in communication with one of said terminating layers;

the gap being formed in the peripheral surface of said electrode film in a closed path and being dimensioned to predetermine the properties of said varistor; and a pair of lead wires, each being attached to one end of said core and being in electrical contact with one of said terminating layers.

13. A method of making a varistor, comprising the steps of:

formulating a varistor powder;

pressing the powder into a cylindrical core having openings at its opposite ends and an outer longitudinal surface;

heating the core at a temperature in the range from about 900° to about 1400° C until the core becomes sintered;

applying a terminating layer to each end of the sintered core;

applying an electrode film to the sintered core with each end of the film in electrical contact with one of the terminating layers;

dividing the electrode film into a pair of electrode portions by forming a gap between the ends of the film; and inserting a lead wire into each end of the core in the core opening and in electrical contact with one of the terminating layers.

14. The method as recited in claim 13, wherein the electrode film is applied to the sintered core by depositing an electrode paste on the outer longitudinal surface of the core and heating the paste until it hardens and forms a film which is in ohmic contact with the core.

15. The method as recited in claim 13, wherein the sintered core is encapsulated within a protective coating after insertion of the lead wires.

16. The method as recited in claim 15, wherein a thin glaze of glass is applied to the electrode portions prior to encapsulation of the sintered core.

17. The method as recited in claim 13, wherein the gap in the electrode film is formed by removing a part of the film in a closed path along the periphery thereof.

18. The method as recited in claim 17, wherein the separation between the electrode portions is increased by removing a part of the sintered core along the closed path followed in removing a part of the electrode film.

19. The method as recited in claim 17, wherein the gap is formed by rotating and translating the sintered core while part of the electrode film is being removed.

20. A method of making a varistor, comprising the steps of:

formulating a varistor powder;

pressing the powder into a cylindrical core;

heating the core at a temperature in the range from about 900° to about 1400° C until the core becomes sintered;

applying a terminating layer to each end of the sintered core;

applying an electrode film to the sintered core with each end of the film in electrical contact with one of the terminating layers;

dividing the electrode film into a pair of electrode portions by forming a gap between the ends of the film, the gap being formed by removing a part of the film in a closed path along the periphery thereof;

the dimensions of the gap being adjusted to predetermine the properties of the varistor; and attaching a lead wire to each end of the core and in electrical contact with one of the terminating layers.

* * * * *